US005297209A

United States Patent [19]

Kowaki

[11] Patent Number: 5,297,209

[45] Date of Patent: Mar. 22, 1994

[54] SYSTEM FOR CALIBRATING SOUND FIELD

[75] Inventor: Hiroshi Kowaki, Kobe, Japan

[73] Assignee: Fujitsu Ten Limited, Hyogo, Japan

[21] Appl. No.: 911,114

[22] Filed: Jul. 9, 1992

[30] Foreign Application Priority Data

Jul. 31, 1991 [JP] Japan ..... 3-192028

[51] Int. Cl.[5] ..... H04H 5/00

[52] U.S. Cl. ..... 381/10; 381/27

[58] Field of Search ..... 381/4, 10, 11, 13, 22, 381/27

[56] References Cited

U.S. PATENT DOCUMENTS 3,737,581 6/1973 Horigone ..... 381/4
3,911,220 10/1975 Tsurushima ..... 381/22
4,817,151 3/1989 Bod et al. ..... 381/10
4,959,859 9/1990 Manlove et al. ..... 381/10

FOREIGN PATENT DOCUMENTS 62-219899 9/1987 Japan .

*Primary Examiner*—Forester W. Isen
*Attorney, Agent, or Firm*—Oliff & Berridge

[57] ABSTRACT

When a stereophonic broadcasting signal is interrupted because an electric field has weakened, a pilot signal 1 which designates that the electric field is not strong enough to separate an R-channel signal and an L-channel signal from a signal received by the tuner, is also interrupted. This interruption of the pilot signal changes gains and/or phases which act on an R-channel signal and/or an L-channel signal which are applied to a sound field calibrating system.

4 Claims, 4 Drawing Sheets

SYSTEM FOR CALIBRATING SOUND FIELD

BACKGROUND OF THE INVENTION

1. Field of the Invention

The present invention relates to a system for calibrating a sound field when receiving a stereophonic broadcasting, and especially to apparatuses that enable the maintenance of a stereophonic broadcasting in spite of an interruption.

2. Description of the Related Art

In recent years, a system for calibrating a sound field to improve presence has been widely used, because digital audio technology processing sound signals digitally has expanded.

It is well-known that this system processes a monophonic signal that is produced by adding an L-channel signal and an R-channel signal, or subtracting an L-channel signal from an R-channel signal.

Presence will be increased by the system that calibrates a sound field using a monophonic signal especially when an orchestra or a big band with vocals is reproduced because the sound to be localized at the center can be clearly maintained.

In the case that the above sound field calibrator is applied to a car audio system, however, listeners experience that presence is suddenly changed when a vehicle passes through an area that has a weak electric field, because the stereophonic tuner outputs same (R+L) monophonic signal from an R-channel output terminal and an L-channel output terminal in that area, and the output signal of the mixing amplifying part is cancelled.

SUMMARY OF THE INVENTION

Therefore, the object of the present invention is to provide a sound field calibrator capable of maintaining presence when a stereophonic broadcasting is interrupted.

According to this invention, when a stereophonic broadcasting signal is interrupted such as when the electric field weakens, a pilot signal that designates that the electric field is strong enough to separate an R-channel signal and an L-channel signal from a signal received by the tuner, is also interrupted.

This interruption of the pilot signal changes gains and/or phases that act on an R-channel signal and/or an L-channel signal that are applied to a sound field calibrator.

BRIEF DESCRIPTION OF THE INVENTION

The present invention will be more clearly understood from the description set forth below with reference to the accompanying drawings.

DESCRIPTION OF THE PREFERRED EMBODIMENTS

Before explaining the present invention, the constitution of a conventional sound field calibrating system is explained to clarify the difference between a conventional system and a sound field calibrating system according to the present invention.

Figure 1:
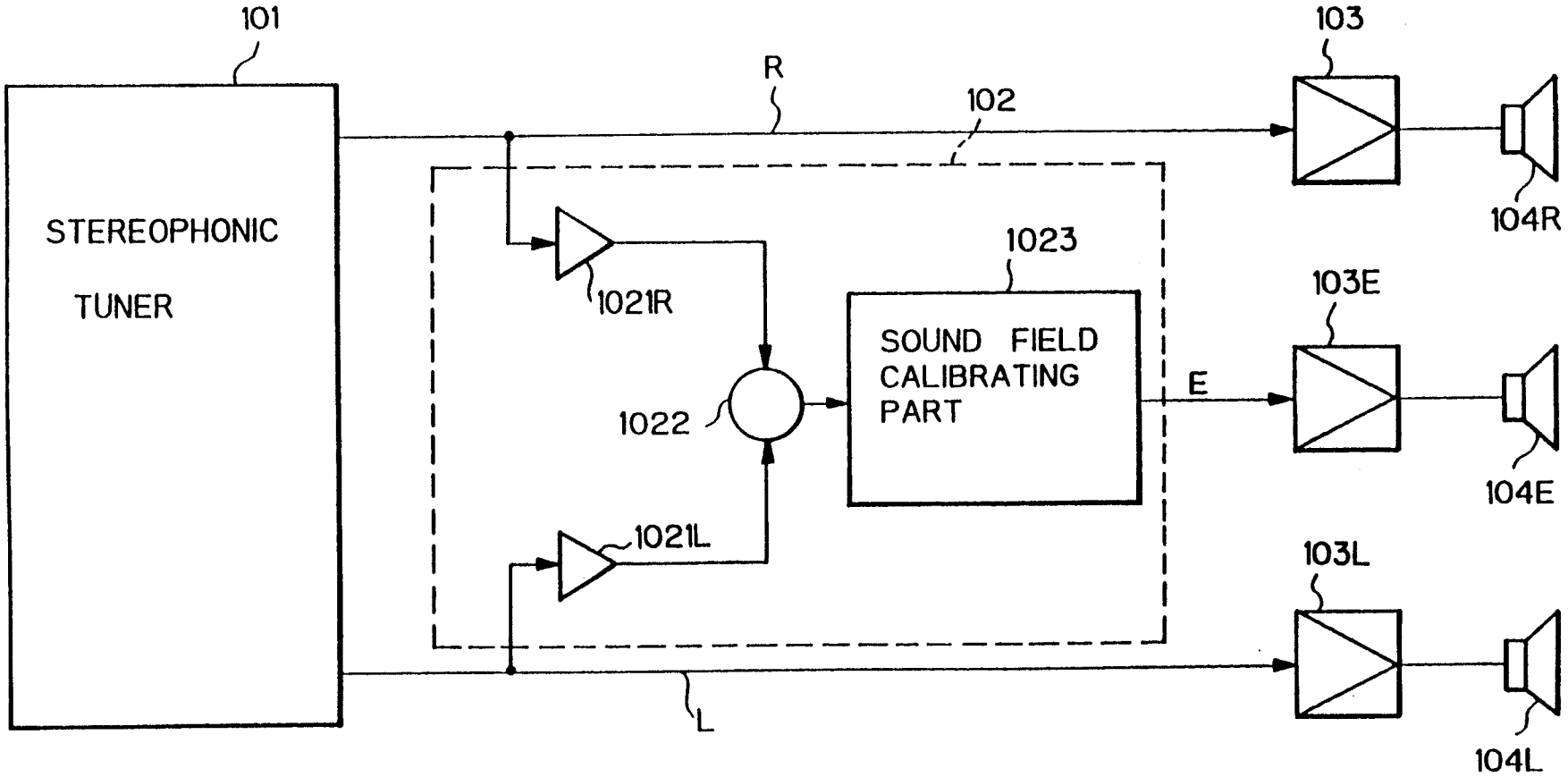
Fig. 1 PRIOR ART
FIG. 1 is a functional diagram of a conventional sound field calibrating system.

FIG. 1 shows the functional diagram of a conventional reproducing system for stereophonic broadcasting with the calibrated sound that is processed by the sound field calibrating system 102 in addition to R-channel sound and L-channel sound.

To calibrate a sound field, an R-channel signal and an L-channel signal output from the tuner 101 are applied to two amplifying parts 1021L and 1021R with a variable phase and a variable gain that are installed in the sound field calibrator 102.

Note, one amplifying part 1021L outputs a non-inverted signal, and other amplifying part 1021R outputs inverted signals to produce one (R−L) signal.

Two output signals from these two amplifying parts 1021L and 1021R are mixed in a mixing part 1022, and the calibrated signal, for example, an initial echo or reverberation signal, is produced by the sound field calibrating part 1023.

The calibrated signal is amplified by a power amplifier 103E and the calibrated sound is radiated from a speaker 104E.

Figure 2:
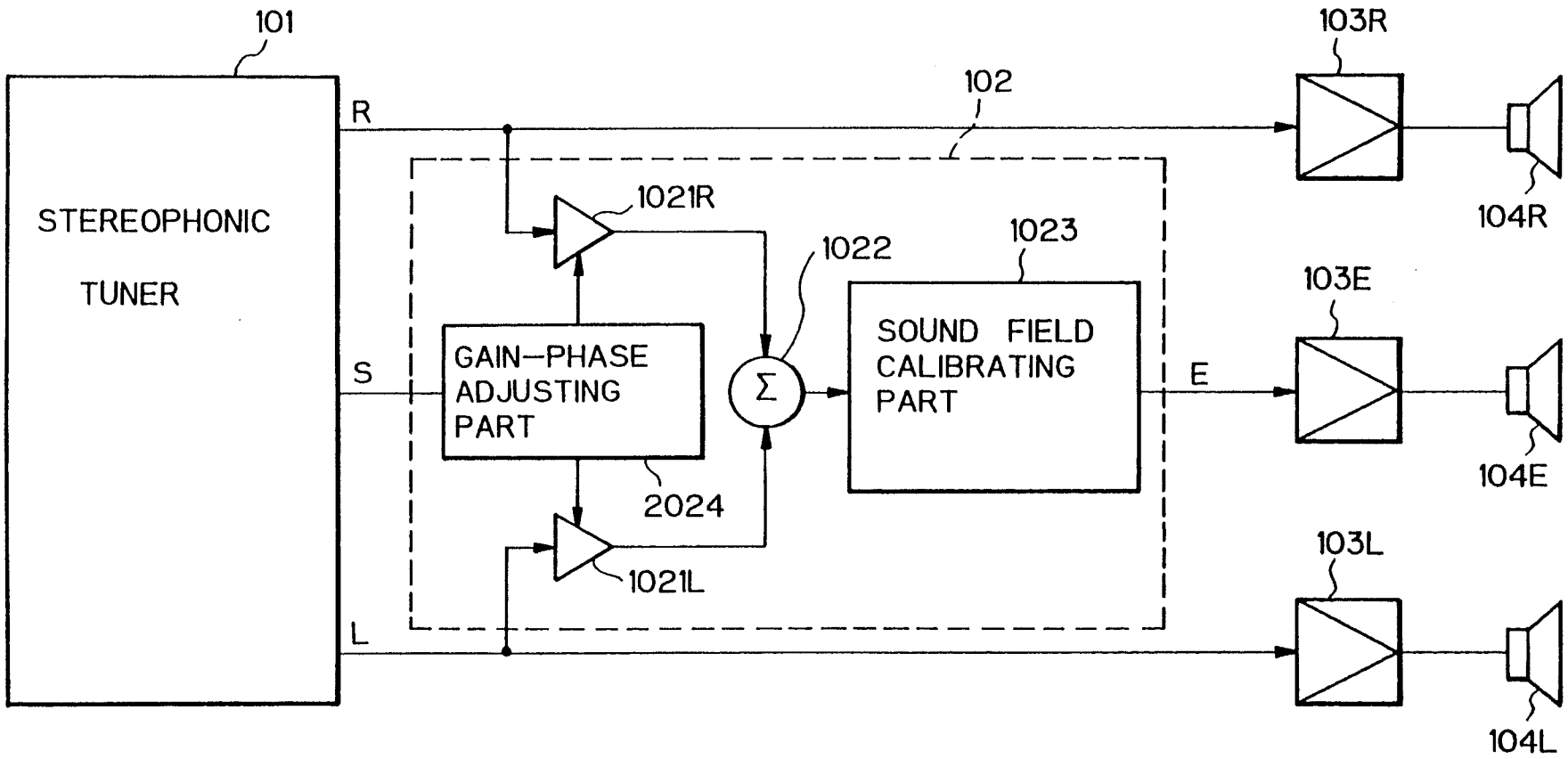
FIG. 2 is a functional diagram of a sound field calibrating system according to the present invention.

FIG. 2, illustrates a sound field calibrating system according to the present invention.

Note, each part illustrated in FIG. 2, which has the same reference numbers as in FIG. 1, has the same function as the corresponding part in FIG. 1.

In the sound field calibrating system according to the present invention, a gain-phase adjusting part 2024 is added and two amplifying parts can have varied output-gains and output-phase.

An R-channel signal and an L-channel signal output from a stereophonic tuner 101, are amplified by two power amplifiers 103R and 103L, and an R-channel sound and L-channel sound are radiated from an R-channel speaker 104R and an L-channel speaker 104L respectively.

And two output signals from the stereophonic tuner 101 are also applied to functional amplifying parts 1021R and 1021L, which have a variable phase and variable gain, and are parts that constituting the sound field calibrating system 102.

In order to generate a differential signal between an R-channel signal and an L-channel signal, the functional amplifying part 1021R is adjusted to output a non-inverted signal and the other functional amplifying part 1021L is adjusted to output an inverted signal.

And gains of two functional amplifying parts 1021R and 1021L are adjusted to the same value, for example 0.5, to prevent a calibrated signal from becoming larger than R-channel and L-channel signals and is equally generated by R-channel and L-channel signals respectively.

That is, the gain-phase adjusting part 2024 controls gains and phases of the functional amplifying parts 1021R and 1021L when the pilot signal S exists as following,

| | |
|---|---|
| R-channel phase | non-inverted |
| gain | 0.5 |
| L-channel phase | inverted |
| gain | 0.5 |

Two output signals output from the functional amplifying parts 1021R and 1021L are mixed in a mixing part 1022, and a mixed signal is applied to a sound field calibrating part 1023 and generates a calibrated sound such as an initial echo and a reverberation sound.

The calibrated signal E is amplified by the power amplifier 103E and the calibrated sound is radiated from the speaker 104E.

When the vehicle moves and the electric field weakens, the stereophonic tuner 101 cannot output R-channel and L-channel signals separated from a received signal, output the same (R+L) signal from R and L channel output terminals, and the pilot signal is interrupted.

When the gain-phase adjusting unit 2024 detects an interruption of the pilot signal, it changes the gains and phases of the functional amplifying parts 1021R and 1021L as following,

| | |
|---|---|
| R-channel phase | non-inverted |
| gain | 0.3 |
| L-channel phase | non-inverted |
| gain | 0.3 |

As a result, it is possible to maintain a natural presence even when the stereophonic broadcasting is interrupted.

Note, the total gain is set at 0.6 to maintain balance between the sounds radiated from the two main speakers 104R and 104L and the calibrated sound radiated from the center speaker 104E.

As another embodiment, the gains and phases of the functional amplifying parts 1021R and 1021L can be selected as following,

| | |
|---|---|
| R-channel phase | non-inverted |
| gain | 0.6 |
| L-channel phase | non-inverted |
| gain | 0.0 |

As hardware of the sound field calibrating system, a DIGITAL SIGNAL PROCESSOR (DSP) can be used.

Figure 3:
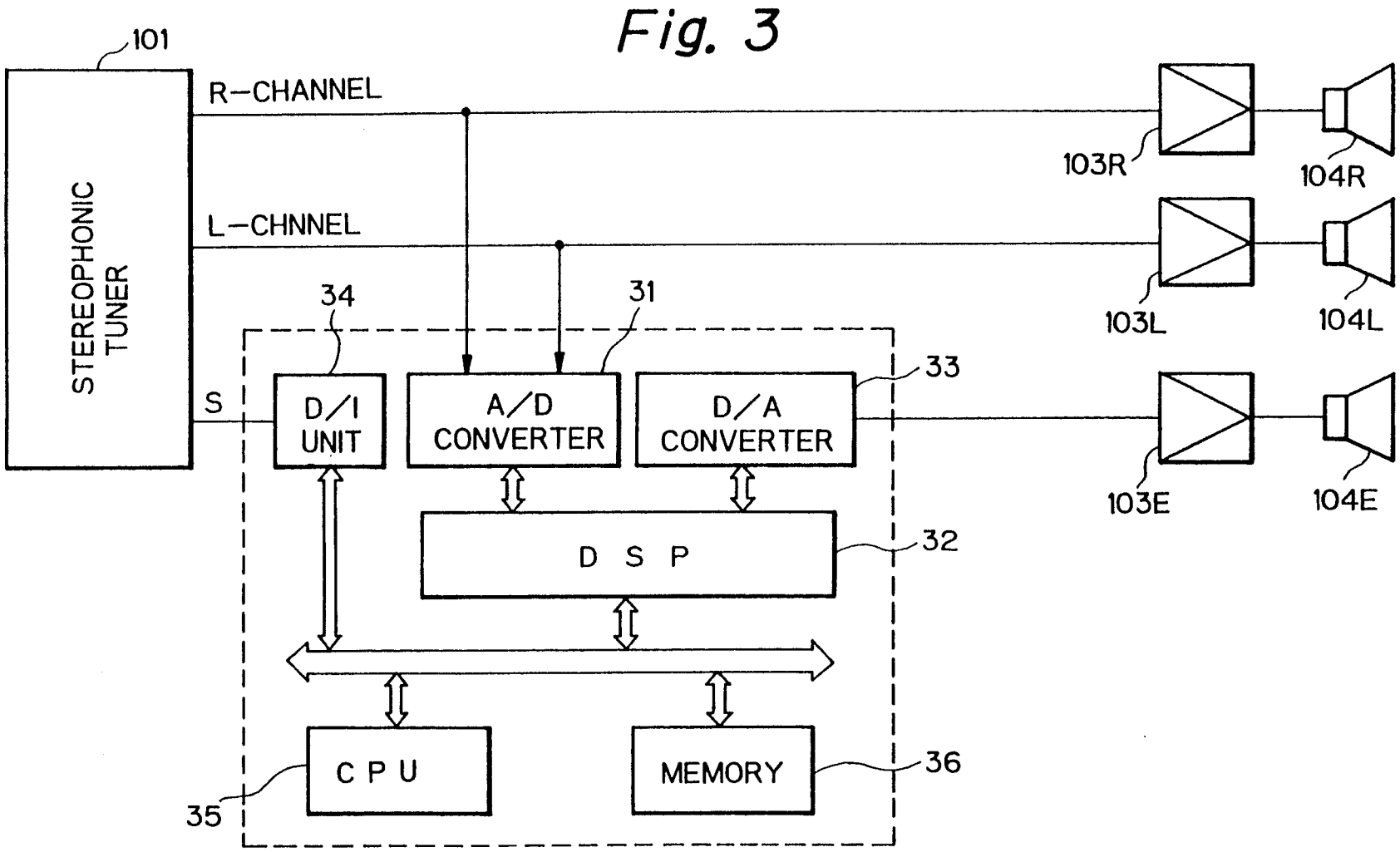
FIG. 3 is a circuit diagram of an embodiment according to the present invention.

FIG. 3 is the circuit diagram according to the present invention.

That is, the R-channel signal and L-channel signal output from the stereophonic tuner 101 are applied to an A/D converter 31 and converted to digital signals.

These digital signals are applied to DSP 32 and the sound field is calibrated.

The calibrated signal is applied to a D/A converter 33 to return to an analog signal. This analog signal is applied to the power amplifier 103E.

The pilot signal S is applied to a digital input (D/I) interface unit 34 to control a program that is executed in the DSP 32.

DSP 32 and D/I interface unit 34 are controlled by a CPU 35, which executes the program stored in a memory 36.

Figure 4:
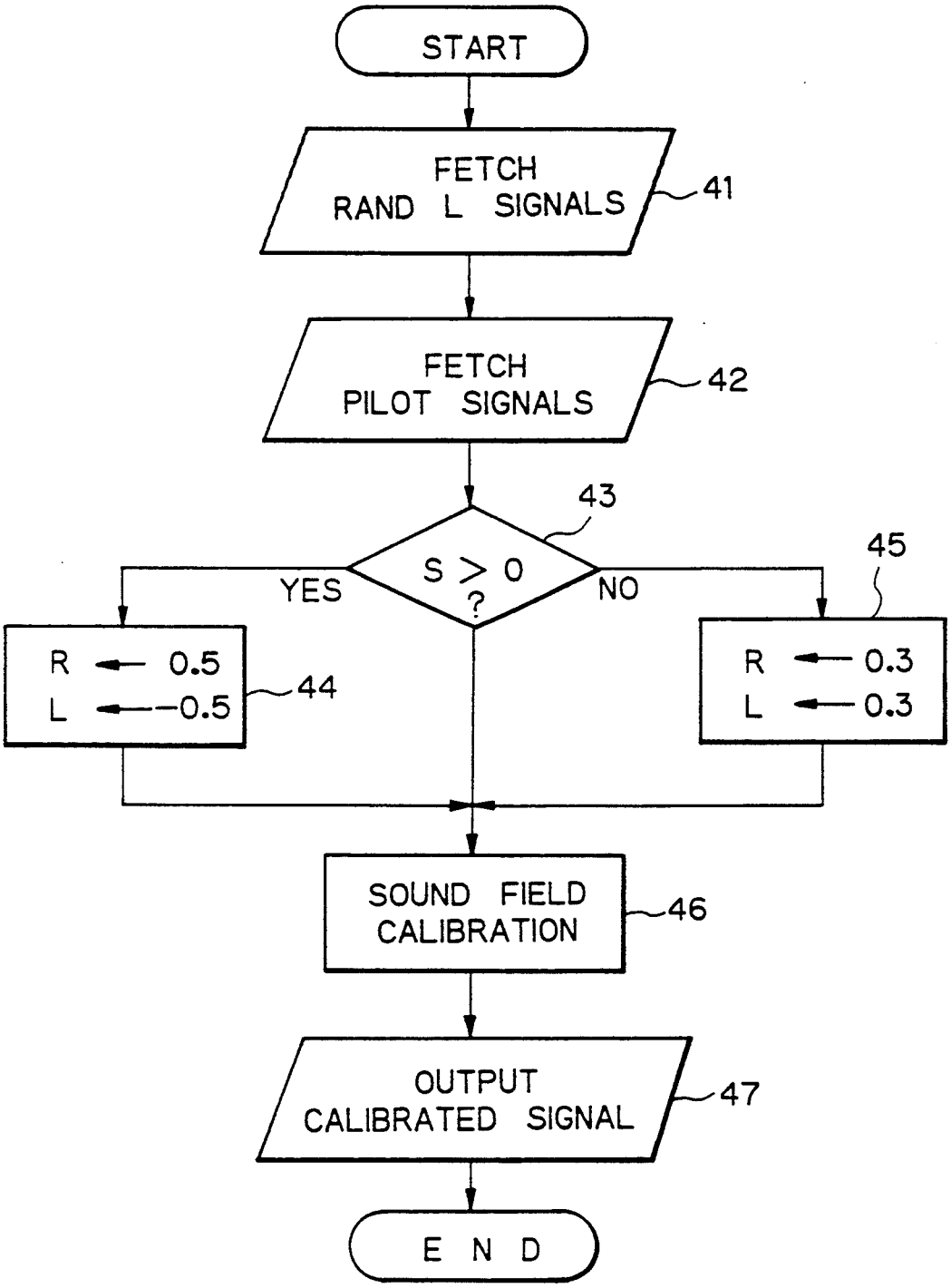
FIG. 4 is a flow chart showing the operation of the gain-phase adjusting part.

FIG. 4 is a flow chart of the gain-phase adjusting control routine that is executed in DSP 32.

At step 41, R-channel signal and L-channel signals are fetched by the A/D converter 31.

At step 42, the pilot signal S fetched by the D/I unit 34 is introduced in DSP 32.

At step 43, it is determined, based on the pilot signal S, whether the stereophonic broadcasting is continuing normally.

When the stereophonic broadcasting is continuing normally, the control proceeds to step 44, where the gains and phases for two functional amplifying parts 1021R and 1021L are set as following.

| | |
|---|---|
| R-channel phase | non-inverted |
| gain | 0.5 |
| L-channel phase | inverted |
| gain | 0.5 |

When the stereophonic broadcasting is not continuing normally the control proceeds to step 45, where the gains and phases are set as following.

| | |
|---|---|
| R-channel phase | non-inverted |
| gain | 0.3 |
| L-channel phase | non-inverted |
| gain | 0.3 |

At step 46, the sound field calibration is performed by the known calibrating method.

At step 47, the calibrated signal is converted to the analog signal by the D/A converter 33, and this routine is completed.

Note, when DSP is used as a hardware for the sound field calibrator, it is possible to store several sets of gains and phases to be set.

I claim:

1. A system for calibrating a sound field when a stereophonic broadcast is interrupted, comprising:

two means for adjusting the respective amplitudes of an R-channel signal and an L-channel signal output from a stereophonic tuner;

a means for mixing the R-channel signal and the L-channel signal output from said two amplitude adjusting means;

a means for generating a calibrating signal in accordance with an output signal from said mixing means;

a means for controlling the amplitudes and the output polarities of the R-channel signal and the L-channel signal from said two means for adjusting in accordance with the state of a pilot signal output from said stereophonic tuner that designates whether or not the stereophonic broadcast is interrupted.

2. A system as set forth in claim 1, wherein said controlling means comprises;

means for setting a gain as 0.5 and setting a polarity as positive for one amplitude adjusting means, and setting a gain at 0.5 and a polarity as negative for another amplitude adjusting means when said stereophonic tuner receives a stereophonic broadcast; and means for setting both gains at 0.3 and setting both polarities as positive for both amplitude adjusting means when said stereophonic tuner receives a monophonic broadcast.

3. A system as set forth in claim 1, wherein said controlling means comprises:

means for setting a gain at 0.5 and a polarity as positive for one amplitude adjusting means, and setting a gain at 0.5 and setting a polarity as negative for another amplitude adjusting means when said stereophonic tuner receives a stereophonic broadcast; and means for setting a gain at 0.6 and setting a polarity as positive for one amplitude adjusting means, and setting a gain as 0.0 for another amplitude adjusting means when said stereophonic tuner receives a monophonic broadcast.

4. A system as set forth in claim 1, further comprising a storing means for storing plural sets of setting values for gains and polarities.

* * * * *